United States Patent [19]

Schnürle et al.

[11] 4,227,491

[45] Oct. 14, 1980

[54] WARM-UP REGULATOR FOR ENRICHING THE AIR-FUEL MIXTURE DELIVERED TO AN INTERNAL COMBUSTION ENGINE

[75] Inventors: Hans Schnürle, Walheim; Richard Bertsch, Asperg, both of Fed. Rep. of Germany

[73] Assignee: Robert Bosch GmbH, Stuttgart, Fed. Rep. of Germany

[21] Appl. No.: 2,480

[22] Filed: Jan. 10, 1979

[30] Foreign Application Priority Data

Feb. 2, 1978 [DE] Fed. Rep. of Germany ..... 2804391

[51] Int. Cl.[3] ..... F02B 3/00

[52] U.S. Cl. ..... 123/488; 123/179 L; 123/491

[58] Field of Search ..... 123/32 ED, 32 EG, 32 EA, 123/32 EL, 32 EH, 179 L, 117 R, 100, 102, 106

[56] References Cited

U.S. PATENT DOCUMENTS

| | | | |
|---|---|---|---|
| 3,664,311 | 5/1972 | Endo | 123/32 EG |
| 3,863,054 | 1/1975 | Monpetit | 123/32 EA |
| 3,901,201 | 8/1975 | Mizuguchi et al. | 123/32 EG |
| 3,964,457 | 6/1976 | Coscia | 123/179 L |
| 3,991,726 | 11/1976 | Kawai et al. | 123/32 EA |
| 4,048,964 | 9/1977 | Kissel | 123/32 ED |

FOREIGN PATENT DOCUMENTS

| | | | |
|---|---|---|---|
| 2311936 | 12/1976 | France | 123/32 EG |

*Primary Examiner*—P. S. Lall

*Attorney, Agent, or Firm*—Edwin E. Greigg

[57] ABSTRACT

A warm-up regulator device for enriching the air-fuel mixture delivered to an internal combustion engine during the engine warm-up phase, said engine having a fuel-metering system with a switching arrangement for generating metering signals in response to a group of engine operating parameters, a compensation stage for correcting the metering signals and a fuel-metering means, wherein the compensation stage is connected to a function generator for producing a signal which is speed-responsive to compensate for condensation losses in the walls of the fuel lines and engine when the engine is cold thus optimizing the operation of the engine. Also disclosed are several ways for reducing the compensation for condensation losses at higher speeds to prevent a negative affect on the exhaust gases and to match the regulator to various engines.

6 Claims, 2 Drawing Figures

WARM-UP REGULATOR FOR ENRICHING THE AIR-FUEL MIXTURE DELIVERED TO AN INTERNAL COMBUSTION ENGINE

BACKGROUND OF THE INVENTION

An internal combustion engine with a fuel-metering system which includes a switching arrangement for generating metering signals responsive to a group of engine operating parameters, a compensation stage for accumulating and correcting said metering signals, a fuel metering means responsive to said metering signals, and a warm-up regulator for enriching the air-fuel mixture delivered to the engine during the warm-up phase is already known in the art. The known warm-up regulator affects the fuel enrichment solely as a function of engine temperature, that is, as part of the cumulative signal processing by the compensation stage. But, in a cold internal combustion engine not all fuel-air mixture injected into the intake manifold reaches the combustion chambers since a significant part of the metered fuel condenses and wets the inner walls of the fuel lines and engine. On the other hand, to have such an enrichment of the fuel over the entire engine operating conditions is unnecessary because the mixture losses due to the wetting of the walls remains substantially equal in magnitude when the load and speed are high. It is at these latter operating conditions that the warm-up enrichment factor as a total percentage of the proportional metering signal is small.

Thus, it becomes clear that it is advantageous to change the warm-up enrichment factor so as to be responsive to additional engine operating conditions rather than relying solely on engine temperature to compensate for the mixture losses when the internal combustion engine is cold.

OBJECT AND SUMMARY OF THE INVENTION

Accordingly, it is a primary object of the present invention to provide an internal combustion engine with a warm-up regulator device responsive to additional engine parameters so that the optimum mixture is available in the combustion chamber during the warm-up period.

This object, and others which will become apparent from a consideration of the disclosure that follows, are accomplished according to the present invention by providing the compensation stage of the fuel metering system with a function generator for producing a correcting signal which is responsive to the engine speed. Thus, the warm-up enrichment factor is a function of a selected speed signal which is attenuated above this selected speed. Other and additional advantages result by the reduction of the enrichment factor from the selected speed to a selected higher speed in linear, curvilinear or in incremental steps as a function of speed to match the enrichment factor to the engine.

The invention will be better understood and further objects and advantages thereof will become more apparent from the ensuing detailed description of the invention in conjunction with the drawings.

DESCRIPTION OF THE PREFERRED EMBODIMENT

Figure 1:
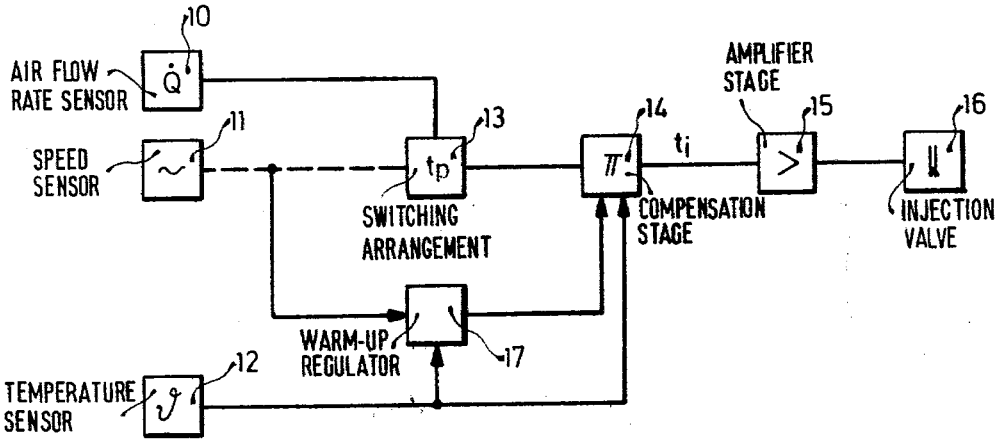
FIG. 1 shows a simplified diagram of an engine warm-up regulator for enriching the air-fuel mixture delivered to an internal combustion engine.

FIG. 1 shows a simplified block diagram of a fuel metering system having a warm-up regulator.

Numerals 10 to 12 denote sensors for sensing the operating engine parameters such as rate of air flow in the intake manifold, speed (RPM) and temperature. Sensor 11 is followed, after signal preparation stages, by a switching element 13 for generating metering signals in response to a first group of operating parameters (load and speed). The switching arrangement is followed by a compensation stage 14 in which the pulses from the switching element 13 are accumulated and corrected, for example, as a function of the temperature and as part of the warm-up enrichment. The compensation stage is followed by an amplifier stage 15 for the injection signals to trigger the solenoid operated injection valves 16.

The warm-up regulator or function generator is denoted by the numeral 17 and influencing variables for said warm-up regulator are a speed signal from speed sensor 11 and a temperature sensor 12. The output of the warm-up regulator 17 is coupled to the compensation stage 14. Finally, the compensation stage 14 is connected directly to the temperature sensor 12 in the event that a temperature responsive control of injection pulses is desired in addition to additional enrichment during warm-up.

Injection pulses are generated in a switching element 13, shown in the block diagram of FIG. 1, in response to load and speed signals and are accumulated and proportioned in the subsequent compensation stage as a function of other operating parameters such as engine and air intake temperatures, air pressure, etc., amplified at amplifier stage 15 and finally passed on to the solenoid operated injection valves 16.

Figure 2:
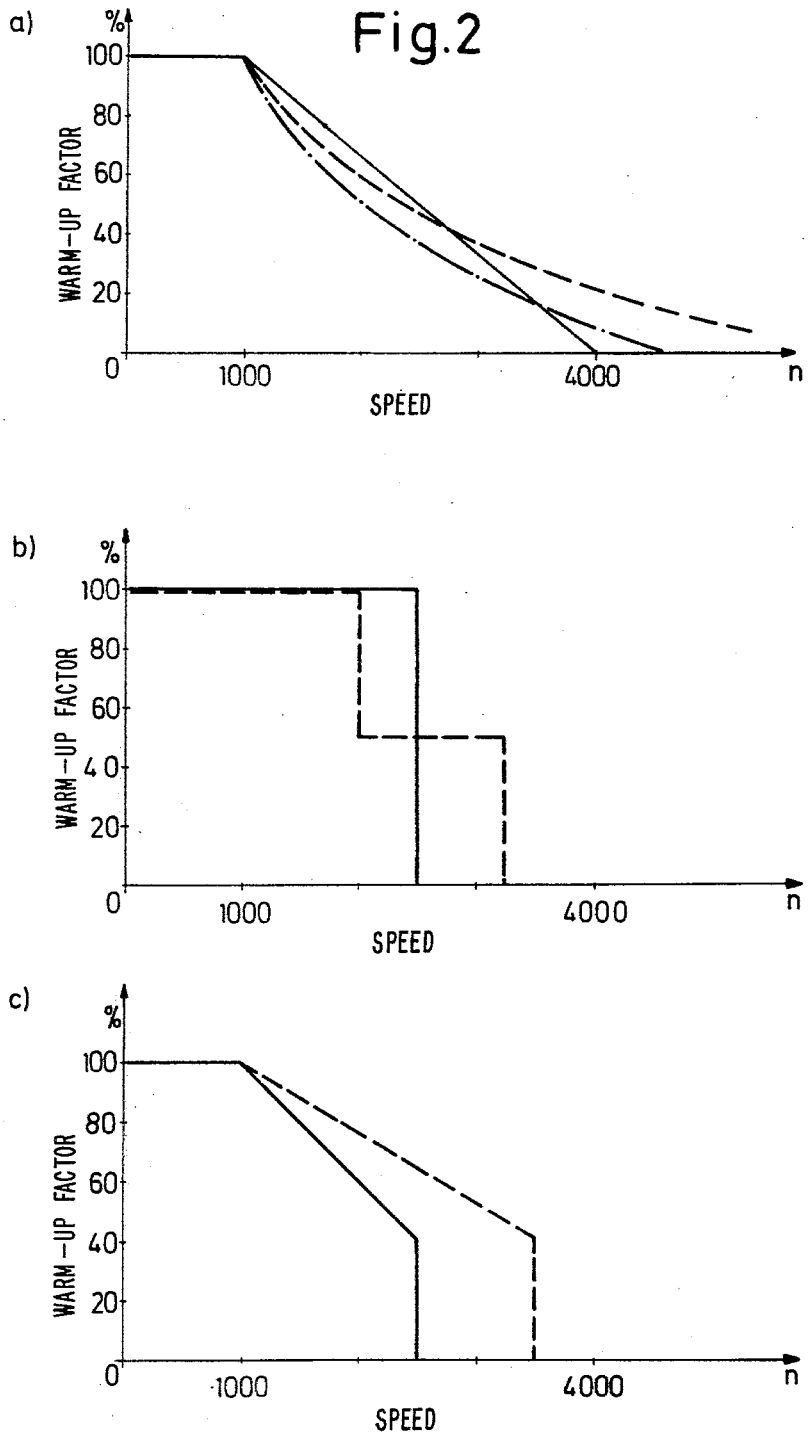
FIG. 2 shows several diagrams (*a*), (*b*) and (*c*), as possible functions of the enrichment factor being reduced above a certain speed.

Warm-up regulator 17 serves to compensate the fuel losses due to condensation of fuel from the air-fuel mixture on the inner walls of the fuel lines and the internal combustion engine and comprises a function generator which delivers an output signal for the control of the compensating stage 14 as a function of the speed of the internal combustion engine. In case of a solely temperature proportional influence on the warm-up enrichment, the internal combustion engine would receive an excessive amount of fuel at high speeds which would have a negative effect on the exhaust gas composition. The attenuation of the enriched mixture at fairly high speeds is necessary, because starting with a given degree of wetting of the internal surfaces of the lines and the internal combustion engine, fuel is sucked away therefrom and forced with the air current into the combustion chambers to make it available for the combustion process. The output signal from the warm-up regulator 17 may have different configurations and may be tuned to the particular type of internal combustion engine. FIG. 2 shows possible configurations.

FIG. 2 contains three groups of diagrams, (*a*) to (*c*), in which the warm-up enrichment factor is plotted against the speed. In all instances, the warm-up factor is held at a constant level up to a speed of 1000 rpm. In the first group of diagrams shown in FIG. 2 (*a*), the warm-up factor above said speed is reduced in various curved shapes.

The solid line marks a linear lowering of the warm-up factor from 100% to 0% within the speed ranges from 1000 to 4000 rpm. A broken and a dash-dotted line illustrate parabolic lowering of the warm-up factor. Hyperbolic curve shapes, too, have proved useful. These curve shapes can make the warm-up enrichment in the proportioning compensation stage 14 additive, since the duration of the output pulses of switching element 13 is inversely proportional to the speed.

The second group of warm-up factors shown in FIG. 2 (*b*) plotted against the speed shows discontinuous lowering of the warm-up factor when certain speed thresholds are exceeded. The solid line marks a single factor jump in the case of a speed of 2500 rpm and the broken line a 2-phase jump with a speed of 2000 and 3250 rpm.

Finally, the group of diagrams of FIG. 2 (*c*) shows combined (i.e., linear and discontinuous) lowering of the warm-up factor plotted against the speed. For example, the warm-up factor above the speed of 1000 rpm drops linearly so as to be lowered discontinuously to zero from a given speed threshold. The rise of the linear drop may be made a function of the temperature and/or load.

The various types of configurations of FIG. 2 also illustrate the most widely differing possibilities of corrective action when determining what the warm-up factor should be relative to speed. If the temperature of the internal combustion engine and of the intake air, as well as the load become the most important influencing variables, the influence of the temperature is still significant because the condensation of fuel on the inner walls of the internal combustion engine and, thereby, the loss of fuel in the air-fuel mixture is substantially dependent on the temperature. The warm-up factor should be load-dependent, because the amount of fuel available in the combustion chambers determines directly the torque that can be produced.

Finally, the function generator 17 in FIG. 1 can be realized with a controllable threshold switch such as an operational amplifier with a means for varying the threshold voltages for producing the desired configurations.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A warm-up regulator device for enriching the air-fuel mixture delivered to an internal combustion engine comprising a fuel-metering system having a switching arrangement for generating metering signals responsive to a first group of operating parameters, a compensation stage which proportions said metering signals responsive to at least a second operating parameter, said compensation stage being connected and responsive to a function generator and said metering signals for producing a compensation signal which is speed-sensitive and a fuel-metering means controlling the injection of fuel into injection valves in response to said compensation stage.

2. A regulator device as set forth in claim 1, wherein an output signal of said function generator is held at a constant level within low speed ranges and is subsequently lowered as higher speeds are attained.

3. A regulator device as set forth in claim 2, wherein the lowering of said output signal is linear.

4. A regulator device as set forth in claim 2, wherein the lowering of said output signal is nonlinear.

5. A regulator device as set forth in claim 2, wherein the lowering of said output signal is in incremental steps.

6. A regulator device as set forth in claim 2, wherein said output signal of said function generator in addition to being responsive to speed is also responsive to temperature.

* * * * *